United States Patent [19]

Doublet

[11] Patent Number: 4,647,016

[45] Date of Patent: Mar. 3, 1987

[54] SAFETY BARRIER AND METHOD OF MANUFACTURING SAME

[76] Inventor: Luc Doublet, 80, rue Burgault, 59113 Seclin, France

[21] Appl. No.: 651,234

[22] Filed: Sep. 17, 1984

[30] Foreign Application Priority Data

Feb. 16, 1984 [FR] France ..... 84 03075

[51] Int. Cl.[4] ..... E04H 17/16

[52] U.S. Cl. ..... 256/24; 256/1; 256/31; 248/163.1

[58] Field of Search ..... 40/606; 248/302, 175, 248/165, 163.1; 211/182, 181; 272/102, 101; 256/31, 24, 1; 228/173.4, 178

[56] References Cited

U.S. PATENT DOCUMENTS

| | | | |
|---|---|---|---|
| 2,503,933 | 4/1950 | Breuer | 248/163.1 |
| 2,556,987 | 6/1951 | Stoudt | 228/173.4 X |
| 3,901,507 | 8/1975 | Santini-Omieres et al. | 228/173.4 X |

FOREIGN PATENT DOCUMENTS

| | | | |
|---|---|---|---|
| 1282729 | 12/1961 | France | 256/24 |
| 80270 | 2/1963 | France | 256/24 |
| 1363138 | 5/1964 | France | 256/24 |
| 1368196 | 6/1964 | France | 256/24 |
| 85197 | 5/1965 | France | 256/24 |
| 2312602 | 12/1976 | France | 256/24 |

*Primary Examiner*—Richard J. Scanlan, Jr.
*Assistant Examiner*—Joseph A. Fischetti
*Attorney, Agent, or Firm*—Robert E. Burns; Emmanuel J. Lobato; Bruce L. Adams

[57] ABSTRACT

This safety barrier comprising a frame and two stands is obtained by bending a tube for forming the lateral uprights and the handrail as well as two first legs of the stands, and by fixing the bottom rail consisting of another tube bent at both ends for forming the legs complementary to the first legs. The angle of divergence and/or the length of one pair of legs forming a first stand differ from those of the other pair of legs forming the other stand of the barrier. The invention is applicable to the iron-work industry in general.

4 Claims, 8 Drawing Figures

SAFETY BARRIER AND METHOD OF MANUFACTURING SAME

BACKGROUND OF THE INVENTION

1. Field of the Invention

The present invention relates to a method of manufacturing a safety barrier and also to a barrier manufactured according to this method.

This invention is applicable more particularly to the iron-work industry, notably in the manufacture of barriers of the type intended for keeping in check crowds during public events.

2. The Prior Art

It is known to construct protection barriers adapted to be assembled in series for constituting a continuous cordon capable of safely preventing the ingress of a given area to persons.

As a rule, these barriers consist of bent tubes welded together and forming a frame of which the inner space is provided with bars and the lower portion is provided with legs welded to the frame and adapted to impart a good stability to the barrier.

From the point of view of manufacture, hitherto known barriers of this character are provided with stands consisting of bent tubular legs welded to the frame. This type of construction though not difficult per se is attended by a relatively high manufacturing cost. To reduce this cost, certain known barriers are provided at one end with a straight leg consisting merely of an extension of one of the uprights. This solution, though economical, is objectionable in that it jeopardizes the stability of the barrier and may thus prove dangerous in actual service.

On the other hand, the use of this straight leg interferes with the rotation of the assembled barriers with respect to each other. In fact, the straight leg prevents the free movement of the insert stand of the adjacent barrier.

Besides, hitherto known barriers cannot be stacked in-line. In-line stacking consists in assembling the frames of the barriers in order to obtain a straight row of barriers. At present, due to the symmetry of their stands, safety barriers must compulsorily be somewhat staggered to one another during the storage thereof, so that the stand of each barrier can be slipped side by side. Thus, no tangling up is likely to occur.

This inconvenience led to the formation of rows of barriers diposed in staggered relationship, so that the floor space occupied in the storage position is relatively important. On the other hand, when the barriers have to be transported on trucks this staggered arrangement is particularly detrimental since it limits the number of barriers that can be transported.

SUMMARY OF THE INVENTION

It is the primary object of the present invention to provide a method of manufacturing safety barriers in which a relatively small number of component elements are implemented. In fact, according to the method of the present invention, it is unnecessary to use insert stands, and since each stand projects on both sides of the barrier, a reliable stability is imparted to the barrier.

Consequently, not only the product obtained with the manufacturing method of the present invention is economical, but in addition it is of very good quality.

Another object of the present invention is to provide a method of manufacturing a safety barrier which permits of obtaining a product adapted to be assembled in the form of straight rows by tangling the barriers into one another and causing their frames to be accurately positioned side by side. This feature is particularly advantageous when the barriers must be transported.

Moreover, the safety barriers obtained through the method of the present invention can be disposed in such mutual arrangement as to form very reduced angles with each other, when necessary. The legs of the adjacent barriers cannot interfere with the free rotation of the barriers as observed with barriers constructed according to prior art methods.

Other features, objects and advantages of the present invention will appear as the following description proceeds with reference to the accompanying drawing.

The method of manufacturing a safety barrier intended more particularly for keeping crowds in check during public events, this barrier consisting of a tubular frame surrounding separation elements such as a grid or a set of bars, kept in proper balance on the floor by means of stands, said frame comprising two lateral uprights, a bottom rail and a handrail, is characterized in that at least one of the stands is obtained by bending one end of a tube constituting one of the uprights, and by bending the end of the tube constituting the bottom rail, and by fixing said tubes.

A clearer understanding of the invention will be had by reading the following description of a typical form of embodiment of the invention given by way of example, not of limitation, with reference to the attached drawing.

THE DRAWING

DESCRIPTION OF THE PREFERRED EMBODIMENT

The present invention is directed to provide an improved method of manufacturing safety barriers of the type intended notably for preventing the free circulation of vehicles or pedestrians. As a rule, barriers of this type are provided with hooking means permitting the assembling of a variable number of barriers for preventing the ingress of persons into a dangerous area.

Figure 1:
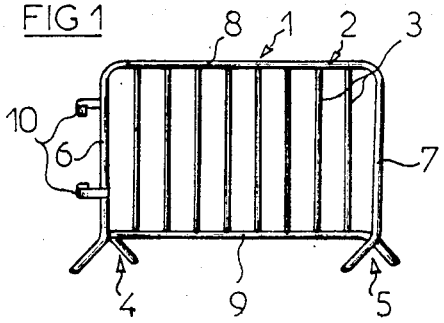
FIG. 1 shows in perspective view a safety barrier according to a preferred form of embodiment of the invention.

As a rule, safety barriers of the type shown at 1 in FIG. 1 comprise a tubular frame 2 surrounding separation elements 3 consisting for example of a grille or lattice work, or more commonly a plurality of bars 3.

This barrier 1 is held in stable equilibrium on the floor or ground by means of a pair of stands 4 and 5.

In most instances the frame 2 comprises a pair of lateral uprights 6, 7, a handrail 8 and a bottom rail 9. Moreover, the frame 2 comprises hooking means 10.

As a rule, these safety barriers are manufactured by mechanically assembling and welding tubes. The cross-sectional shape of the tube is immaterial. However, in most cases a circular cross-section is preferred.

The present invention is applicable irrespective of the selected cross-sectional configuration. However, in order to reduce weight and impreove the mechanical strength, tubes having a circular cross-section are preferred.

Figure 2:
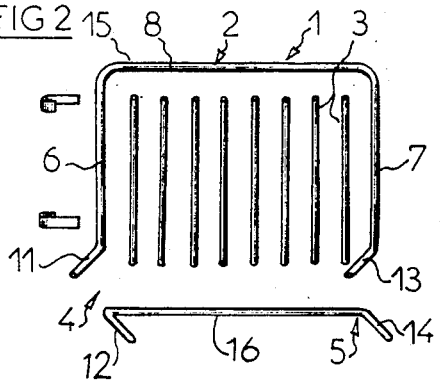
FIG. 2 is an exploded view showing the various component elements of the safety barrier of FIG. 1.

According to the method of the present invention, as illustrated more particularly in FIG. 2, at least one of the stands 4 or 5 is obtained by simply bending one end of the tube constituting the bottom rail 9, so as to provide a pair of legs 11, 12 constituting the stand 4, said legs 11, 12 extending on either side of the barrier and imparting the necessary stability thereto.

The same manufacturing method could be used for the other stand 5 by bending the end 13 of the tube constituting the upright 7 and by bending the end 14 of the tube constituting the bottom rail 9. The legs 13 and 14 constitute the other stand 5 projecting on either side of the barrier 1.

According to the manufacturing method of the present invention, the same procedure is applicable for making either the stand 4 and/or the stand 5. Preferably, the barrier 1 should be provided with two stands 4 and 5 projecting on either side of the barrier in order to impart an improve stability thereto. However, one of the legs could be obtained if desired by extending the end of upright 7 without bending this end for constituting a straight leg.

In order to minimize the number of component elements necessary for constructing a barrier 1, the manufacturing method of the present invention comprises the step of shaping the frame 2 and stands 4 and 5 by bending on the one hand a tube 15 for forming the handrail 8 and the uprights 6, 7, and on the other hand at least one end 11 or 13 of said tube 15 in order to provide a leg 11 or 13 of stand 4 or 5. A second tube 16 is added by welding to said tube 15 for constituting the bottom rail 9, at least one end 12 or 14 of this tube 16 being bent to form the other leg 12 or 14 of stand 4 or 5.

Preferably, the frame 2 and stands 4 and 5 are formed by bending a tube 15 in order to provide both uprights 6, 7, the handrail 8, as well as the two legs 11 and 13 of stands 4 and 5, and by fixing the bottom rail 9 consisting of a tube 16 bent at both ends for forming the legs 12 and 14 complementary to stands 4 and 5.

Figure 3:
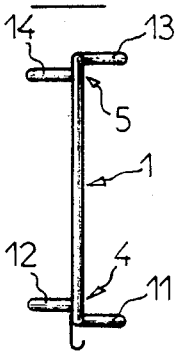
FIG. 3 is a plan view from above of the safety barrier of the present invention.

FIG. 3 is a plan view from above of a safety barrier 1 provided with two stands 4, 5 projecting from either side thereof.

Figure 4:
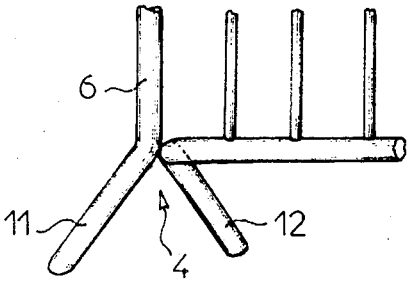
FIG. 4 is a perspective view showing a constructional detail of one of the stands of the safety barrier according to the present invention.

According to a preferred form of embodiment of the method of the present invention, the tube 16 intended for forming the bottom rail 9 is bent in such a way that this bottom rails can be secured between uprights 6 and 7. Thus, when fixing the tube 16 to tube 15, the leg 12 is welded to the inner surface of upright 6 as shown in FIG. 4. With this arrangement, a certain degree of staggering is created between legs 11, 12 and 13, 14.

This staggering is visible in FIG. 3. The stagerring between the longitudinal axes of legs 11 and 12 or 13 and 14 corresponds to the diameter of the tube size utilized for making the frame 2.

According to the method of the present invention, the ends 11, 12, 13 and 14 of tubes 15 and 16 for making the uprights 6, 7 and the lower rail 9 are so bent that the resulting legs 11, 12, 13 and 14 are somewhat staggered when said tubes 15 and 16 are fixed in position.

Figure 5:
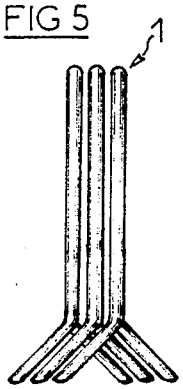
FIG. 5 shows a plurality of safety barriers according to the present invention in their storage condition.

With this arrangement it is possible to tangle up the barriers 1 as shown in FIG. 5. In fact, the staggering of legs 11, 12, 13 and 14 of stands 4 and 5 of barrier 1 permits of inserting the barriers 1 into one another as shown in FIG. 5. This possiblity of stacking or interlocking the barriers in the form of straight rows is particularly advantageous in that it reduces appreciably the floor space occupied by the barriers in their storage condition. The frames 2 of barriers 1 can be assembled in end to end relationship because, due to the leg staggering, the legs do not interfere with the passage of the legs of the adjacent barrier.

Figure 6:
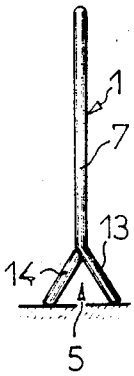
FIG. 6 is a side elevational view of a safety barrier according to the present invention.
Figure 7:
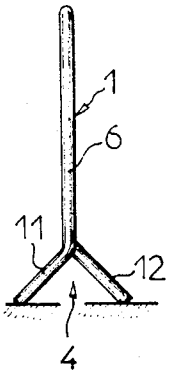
FIG. 7 shows the same safety barrier but seen from the opposite side with respect to FIG. 6.

According to the method of the present invention, the ends 11, 12, 13 and 14, of tubes 15 and 16 forming the frame 2 are so bent that they form legs 11, 12, 13 and 14 of stands 4 and 5 which have different dimensions at each ends, as clearly shown in FIGS. 6 and 7.

It is also possible to bend the ends 11, 12, 13 and 14 of tubes 15 and 16 constituting the frame 2 in such a way that the resultant legs 11, 12, 13 and 14 diverge by a different angle in relation to the uprights 6 and 7 for each stand 4 and 5.

With this specific arrangement it is possible to obtain stands 4 and 5 of different overall dimensions while preserving a good stability of the barrier and keeping the horizontality of the rails and permitting the relative hinged coupling of adjacent barriers in any desired angular relationship, even with a very narrow angle.

Figure 8:
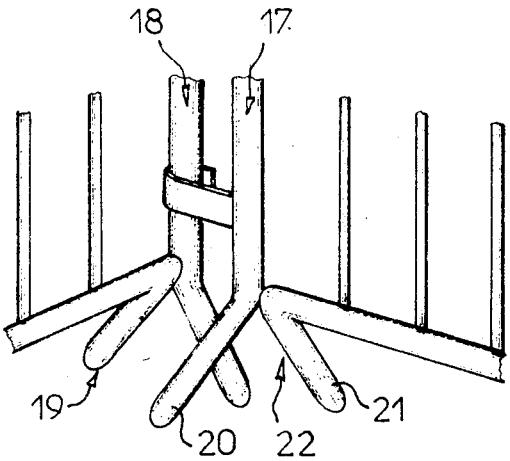
FIG. 8 is a fragmentary perspective view of the pivotal assembling of two safety barriers according to the present invention, showing the imbrication of their stands.

As illustrated in FIG. 8, one barrier 17 can rotate without interfering in any way with an adjacent barrier 18, since the stand 19 of this other barrier 18 which, as illustrated, corresponds to stands of reduced dimensions, can pivot between the legs 20 and 21 constituting the stand 22 of said one barrier 17 of greater dimensions.

Thus, the manufacturing method according to the preferred form of embodiment thereof is attended by many advantageous features such as a free rotation of the barriers with respect to one another, and also the possibility of stacking the barriers to form straight rows thereof.

The safety barrier 1 of the present invention is characterized in that at least one of the stands 4 or 5 is obtained by bending the two ends 11, 12 or 13, 14 of tubes 15, 16 constituting the main elements of frame 2.

The stands 4 and 5 consist in fact of legs 11, 12, 13, 14 projecting on either side of the barrier 1 and having different lengths for each stand 4 and 5, as shown in FIG. 3.

Moreover, the angle of divergence of legs 11, 12 and 13, 14 with respect to uprights 6 and 7 differs when making each stand 4, 5.

Of course, various changes and modifications may be brought by any person of ordinary skill to the particular form of embodiment of the invention shown and described herein without departing from the basic principles of the invention, as will readily occur to those conversant with the art.

What is claimed is:

1. A safety barrier intended in particular for preventing the free passage of vehicles or pedestrians comprising:

a first tube bent to form an upper horizontal rail and two lateral uprights, lower end portions of said uprights being bent at an angle to the plane of said upper rail and said uprights to form a first leg of each of two stands for supporting said barrier and maintaining it in equilibrium on the ground, a second tube forming a lower rail of said barrier, end portions of said second tube being bent to form a second leg of each of said two stands, said second tube being of such length that the bends of said second tube forming said second legs are juxtaposed to the bends of said first tube forming said first legs, said first and second tubes being joined with one another to form a barrier body by joining the bends of said first tube forming said first legs with the bends of said second tube forming said second legs, said second tube being rotationally oriented with respect to said first tube so that said second legs are disposed at approximately the same angle to the plane of said upper rail and said uprights as said first legs, said second legs being offset from said first legs by approximately the thickness of said legs and the legs of one stand diverging at a different angle to one another than the legs of the other stand.

whereby when two barriers are placed side by side, the legs of one barrier fit between the legs of the other barrier; and barrier elements installed in said body.

2. A barrier according to claim 1, in which said second tube is of such length that bends of said second tube forming said second legs fit between bends of said first tube forming said first legs.

3. A barrier according to claim 1, in which the end portions of said first tube forming said first legs are bent to the same side of the plane of said upper rail and said uprights and said bent end portions of said second legs lie in the same plane with one another.

4. A barrier according to claim 1, in which the legs of one stand are of different length than the legs of the other stand.

* * * * *